US011281244B2

(12) United States Patent
Matyscak

(10) Patent No.: US 11,281,244 B2
(45) Date of Patent: Mar. 22, 2022

(54) OUTPUT CURRENT LIMITER FOR A LINEAR REGULATOR

(71) Applicant: SEMICONDUCTOR COMPONENTS INDUSTRIES, LLC, Phoenix, AZ (US)

(72) Inventor: Jiri Matyscak, Roznov Pod Radhostem (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/714,048

(22) Filed: Dec. 13, 2019

(65) Prior Publication Data

US 2021/0018944 A1 Jan. 21, 2021

Related U.S. Application Data

(60) Provisional application No. 62/875,343, filed on Jul. 17, 2019.

(51) Int. Cl.
*G05F 1/56* (2006.01)

(52) U.S. Cl.
CPC ..... *G05F 1/56* (2013.01)

(58) Field of Classification Search
CPC ..... G05F 1/56; G05F 1/46; G05F 1/461; G05F 1/462; G05F 1/465; G05F 1/561; G05F 1/562; G05F 1/563; G05F 1/565; G05F 1/573; G05F 1/5735; G05F 1/575; G05F 1/59; G05F 1/595; G05F 1/613; G05F 1/614; G05F 1/618; H05F 3/26; H05F 3/262; H05F 3/265; H05F 3/267; H05F 3/30; H05F 3/16; H05F 3/20; H05F 3/205; H05F 3/227; H05F 3/24; H05F 3/242; H05F 3/247
USPC ..... 323/270–289
See application file for complete search history.

(56) References Cited

U.S. PATENT DOCUMENTS 4,914,357 A * 4/1990 Valley ..... G05F 1/5735 315/309
5,559,424 A * 9/1996 Wrathall ..... G05F 3/267 323/277
5,672,961 A * 9/1997 Entrikin ..... G05F 3/225 323/315

(Continued)

OTHER PUBLICATIONS

ON Semiconductor, "NCP120, 150mA, Very Low Dropout Bias Rail CMOS Voltage Regulator," Oct. 2015.

(Continued)

*Primary Examiner* — Kevin J Comber
*Assistant Examiner* — Nusrat Quddus
(74) *Attorney, Agent, or Firm* — Brake Hughes Bellermann LLP

(57) ABSTRACT

A voltage regulator having a current limiter for over-current protection is disclosed. The current limiter is powered by a current or currents derived from an output current. In a no-load condition, in which the output current is zero, the current or currents powering the current limiter may be zero. As the output current increases, however, the current or currents powering the current limiter may grow in proportion. Thus, the current limiter can have zero quiescent current in a no-load condition but may be powered to protect the voltage regulator in a high-current condition.

17 Claims, 4 Drawing Sheets

(56) References Cited

U.S. PATENT DOCUMENTS 5,889,393 A * 3/1999 Wrathall ..... G05F 1/565 323/280
7,030,662 B1 * 4/2006 Stiff ..... G05F 1/561 327/103
7,215,103 B1 * 5/2007 Wong ..... G05F 1/573 323/270
7,541,796 B2 * 6/2009 Imtiaz ..... G05F 1/575 323/280
7,714,552 B2 * 5/2010 Gerber ..... G05F 1/56 323/273
8,319,560 B2 * 11/2012 Kocer ..... H03F 1/305 330/296
9,588,541 B1 * 3/2017 Ho ..... G05F 1/573
9,740,221 B2 * 8/2017 Cavallini ..... G05F 1/468
9,977,445 B2 * 5/2018 Cui ..... G05F 1/575
10,310,526 B2 * 6/2019 Malinowski ..... G05F 1/575
10,416,695 B1 * 9/2019 Bohannon ..... G05F 1/575
10,803,968 B2 * 10/2020 Kunz ..... G05F 1/575
2002/0130646 A1 * 9/2002 Zadeh ..... G05F 1/575 323/275
2003/0178976 A1 * 9/2003 Xi ..... G05F 1/575 323/273
2006/0055383 A1 * 3/2006 Eberlein ..... G05F 1/575 323/280
2006/0091961 A1 * 5/2006 Briskin ..... H03K 17/0822 330/298
2007/0216383 A1 * 9/2007 Al-Shyoukh ..... G05F 1/468 323/280
2009/0167263 A1 * 7/2009 Wang ..... G05F 3/262 323/266
2009/0180231 A1 * 7/2009 Tanaka ..... G05F 1/573 361/93.9
2009/0195301 A1 * 8/2009 Narayanan ..... G05F 3/30 327/539
2009/0195953 A1 * 8/2009 Chen ..... G05F 1/573 361/87
2009/0322429 A1 * 12/2009 Ivanov ..... H03F 3/45179 330/257
2010/0156518 A1 * 6/2010 Hoque ..... G05F 1/56 327/538
2010/0156528 A1 * 6/2010 Couchman ..... H03F 1/0205 330/124 R
2010/0213917 A1 * 8/2010 Pulijala ..... G05F 1/575 323/293
2011/0133707 A1 * 6/2011 Giroud ..... G05F 3/30 323/265
2012/0187930 A1 * 7/2012 Williams ..... G05F 1/5735 323/273
2013/0147448 A1 * 6/2013 Kadanka ..... G05F 1/565 323/280
2013/0285631 A1 * 10/2013 Bisson ..... G05F 1/575 323/280
2013/0293986 A1 11/2013 Lerner et al.
2013/0332750 A1 * 12/2013 Souma ..... H02H 3/087 713/300
2014/0253083 A1 * 9/2014 Shao ..... H02M 1/32 323/285
2015/0212530 A1 * 7/2015 Forejtek ..... G05F 1/56 323/280
2015/0286231 A1 * 10/2015 Gerber ..... G01R 19/00 323/281
2016/0043539 A1 * 2/2016 Mallala ..... G05F 1/569 361/18
2016/0154415 A1 * 6/2016 B z itu ..... G05F 1/575 323/280
2016/0282890 A1 * 9/2016 Malinowski ..... G05F 1/575
2020/0042026 A1 * 2/2020 Wang ..... G05F 1/563
2020/0272184 A1 * 8/2020 Petenyi ..... G05F 1/575
2020/0285262 A1 * 9/2020 Kunz ..... G01R 19/16552
2020/0286574 A1 * 9/2020 Kunz ..... G01R 19/16552

OTHER PUBLICATIONS

ON Semiconductor, "NPC137, 700 mA, Very Low Dropout Bias Rail CMOS Voltage Regulator," Sep. 2018.

* cited by examiner

OUTPUT CURRENT LIMITER FOR A LINEAR REGULATOR

CROSS-REFERENCE TO RELATED APPLICATION

This application claims the benefit of U.S. Provisional Application No. 62/875,343, filed on Jul. 17, 2019 and entitled "ZERO-QUIESCENT-CURRENT AUTO-BIASED CURRENT LIMIT PROTECTION", the contents of which are hereby incorporated by reference in their entirety.

FIELD OF THE DISCLOSURE

The present disclosure relates to microelectronic analog circuits and in particular, to a linear voltage regulator circuit (i.e., linear regulator) that is configured to limit an output current of the linear regulator in an overload (e.g., short) condition and to draw low (e.g., zero) quiescent current in a no-load (e.g., standby) condition.

BACKGROUND

Linear regulators that are configured to minimize a voltage drop between an input and an output (i.e., a dropout voltage) are known as low-dropout voltage regulators (i.e., LDO regulators). The simplicity of LDO regulators make them desirable for applications having a small size, weight, and/or cost (e.g., mobile phone).

An LDO regulator (i.e. LDO) is configured to regulate the output voltage based on an adjustable voltage drop (i.e., controllable voltage drop) across input/output terminals of the LDO, which correspond to terminals (e.g., source/drain terminals, emitter/collector terminals) of an output transistor. The LDO regulates by comparing the output voltage to a reference voltage in order to produce a control signal (i.e., voltage error signal) that is used to adjust a controlling terminal (e.g., gate, base) of the output transistor, thereby adjusting the voltage drop across the output transistor so that the output voltage corresponds to (e.g., matches) the reference voltage. Because the regulation operates via dissipation, power efficiency is an important characteristic of the LDO regulator.

The power efficiency of an LDO regulator is affected by a current required for the operation of the circuitry of the LDO regulator. This current is known as the quiescent current (i.e., $I_Q$) of the LDO regulator. In an operating condition, the output current of the LDO regulator (i.e., $I_{OUT}$) is much greater than the quiescent current. In an idle (i.e. standby) condition (i.e., a no-load condition), the output current of the LDO regulator can be zero, but the LDO regulator will still draw the quiescent current. Accordingly, minimizing the quiescent current is important, especially for applications requiring power-efficient circuitry (e.g., battery-operated devices). It is in this context that implementations of the disclosure arise.

SUMMARY

In at least one aspect, the present disclosure generally describes a voltage regulator. The voltage regulator includes a loop that is configured to compare an output voltage to a reference voltage. The voltage loop is also configured to adjust the output voltage to match the reference voltage. The voltage regulator also includes a current loop that is configured to monitor an output current and to draw current from the voltage loop to limit the output current when the output current is at or above a current limit threshold. The current loop of the voltage regulator is powered by one or more bias currents that are related to the output current.

In a possible implementation, the one or more bias currents are not fixed, and when the output current is zero, the one or more bias currents are zero; however, an increase in the output current can cause a proportional increase in the one or more bias currents.

In another aspect, the present disclosure generally describes a linear dropout regulator (LDO). The LDO includes an output transistor configured to provide a controllable voltage drop between an input and an output of the LDO. The LDO also includes a current limiter powered according to an output current and configured to limit the output current of the LDO in an overload condition. The current limiter includes a first stage, a second stage, and a third stage. The first stage includes a current-sense transistor and a current-sense resistor. The current-sense transistor and current sense resistor are configured to output a sensed-current voltage that corresponds to the output current. The second stage includes a comparator with an offset voltage (i.e., an offset comparator) that is configured to receive the sensed-current voltage. The third stage includes a current-limiting transistor that is driven by the comparator to control the output transistor when the sensed-current voltage is at or above the offset voltage.

In a possible implementation, the current limiter draws zero quiescent current in a no-load condition and is powered by current derived from the output current.

In another aspect, the present disclosure generally describes a method for voltage regulation with current limiting. The method includes regulating an output voltage using a voltage loop. The method further includes sensing an output current and powering a current loop using a current derived from the output current. The method further includes enabling the current loop to draw current out of the voltage loop to limit an output current.

In a possible implementation, the method includes not powering the current loop when the output current is zero (e.g., to make the quiescent current drawn by the current loop in a no-load condition equal to zero).

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

The present disclosure describes a voltage regulator having a current limiter circuit (i.e., limiter) for protection. The limiter is configured to maintain an output current of the voltage regulator within a range below a maximum current level. When a heavy load (e.g., a short) is coupled to the output of the voltage regulator, the limiter is used (e.g., necessary) to protect the voltage regulator from high current damage, but when a light load (e.g., no load) is coupled to the output of the voltage regulator the limiter is not used (e.g., not necessary) for operation. The disclosed circuits and methods describe a limiter that consumes little or no current for light loads but can still operate to limit the current for heavy loads. In other words, the disclosed circuits and methods describe a current limit protection circuit that has low (e.g., zero) quiescent current Eliminating the quiescent current of the limiter can increase an overall efficiency of the voltage regulator or can expand a usable power budget for other functions of the voltage regulator, which can improve performance for a fixed power budget.

Figure 1:
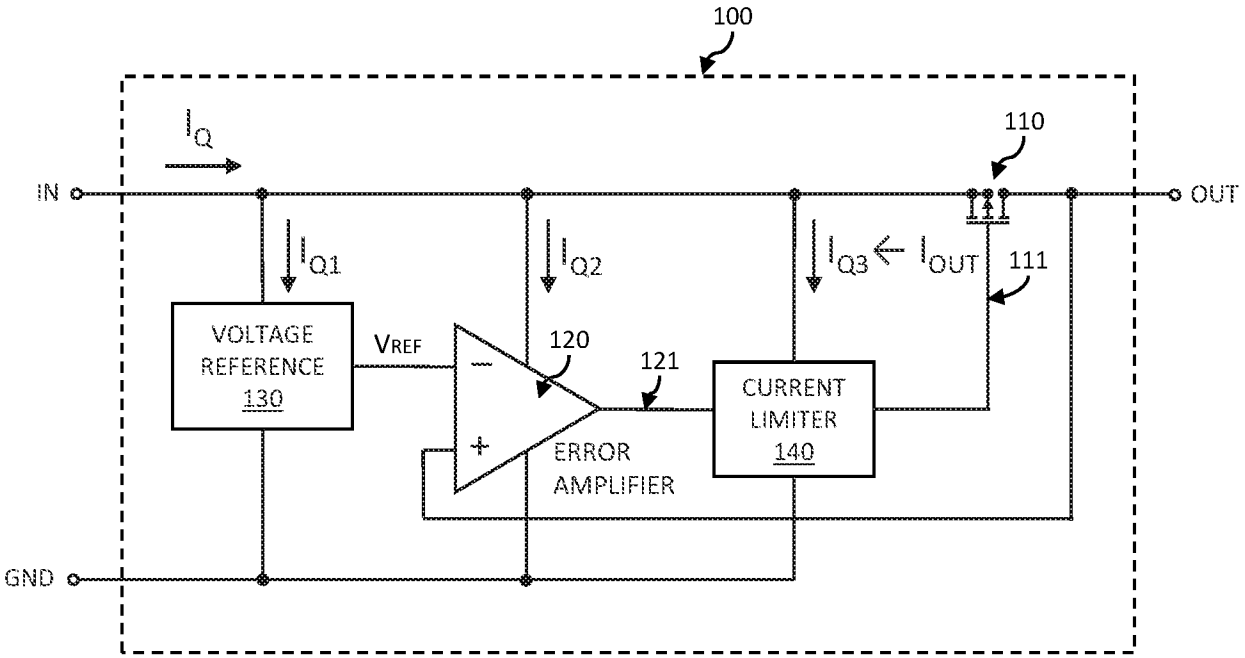
FIG. 1 is a block diagram of a linear regulator with over-current protection according to an implementation of the present disclosure.

FIG. 1 is a general system block diagram of a linear regulator with over-current protection according to an implementation of the present disclosure. The voltage regulator 100 includes an output transistor device 110 (i.e., transistor) with a voltage drop controlled by the output of an error amplifier 120. The output of the error amplifier is based on a difference between a reference voltage source (i.e., voltage reference) 130 and the output (i.e., voltage) of the voltage regulator (OUT), which is fed back to an input (e.g., non-inverting input) of the error amplifier 120.

In operation, a voltage at the input of the voltage regulator (IN) is reduced by an amount determined by the voltage drop across the output transistor 110. The output transistor 110 may be of various types (e.g., N-type, P-type) and/or technologies (e.g., BJT, JFET, MOSFET). For example, the output transistor 110 may be a P-type metal oxide semiconductor field effect (MOSFET) transistor as shown in the implementation of FIG. 1. The output transistor may be coupled in series with between the input (IN) and the output (OUT) of the voltage regulator. For example, the P-type MOSFET transistor (i.e., PMOS transistor) of FIG. 1 has a source terminal coupled to the input and a drain terminal coupled to the output. The output current and the voltage drop between the gate and the source terminals ($V_{GS}$) can be controlled by current/voltage applied to a gate terminal of the output transistor 110. In normal (i.e., non-current-limited) operation the current/voltage applied to the gate terminal is provided by the error amplifier so that the output voltage of the regulator equals the voltage reference, even as the load changes.

The voltage regulator also includes a current limit protection circuit (i.e., current limiter) 140. The current limiter senses the output current of the voltage regulator. When the output current is high (e.g. above a threshold) the current limiter takes control of the output of the voltage regulator circuit to limit the current.

For operation, the voltage reference 130 can draw a first quiescent current ($I_{Q1}$), the error amplifier 120 can draw a second quiescent current ($I_{Q2}$), and the current limiter can draw a third quiescent current ($I_{Q3}$). In other words, the quiescent current of the voltage regulator in a load condition can be given by the equation:

$$I_Q=I_{Q1}+I_{Q2}+I_{Q3}.$$

The disclosed circuits and methods minimize (e.g., eliminate) the third quiescent current (i.e., the current limiter bias current) in a no-load condition by self-biasing the limiter's circuitry with currents derived from the output current. The third quiescent current can, therefore, be minimized (e.g., made zero) when the output current is zero (i.e., no-load condition). Such a condition may arise when, for example, the voltage regulator is placed in a stand-by mode. Accordingly, the overall quiescent current of the disclosed voltage regulator is reduced in the no-load condition because the quiescent current of the voltage limiter is approximately zero (e.g., zero quiescent current), as shown by the equation:

$$I_Q=I_{Q1}+I_{Q2}.$$

The current limiter 140 is biased for operation by a current based on the output current of the voltage regulator. As the output current rises, the current limiter 140 is gradually biased and activated. When fully activated, the current limiter 140 takes driving current away from the controlling (e.g., gate) terminal of the output transistor so that the output 121 of the error amplifier 120 is disconnected from the gate 111 of the output transistor. In other words, in an overload condition, a drop in the output voltage at the output (OUT) of the voltage regulator can cause the error amplifier to increase the gate voltage of the output transistor. When this happens, the limiter 140 can limit the output current by preventing the error amplifier 120 from increasing the gate voltage of the output transistor beyond a maximum value. In this condition the output current is limited to a maximum value, even if the output voltage continues to drop.

In a normal condition in which the output current of the voltage regulator is below a current-limit threshold, the output voltage is controlled (i.e., made constant) at the output. In other words, the voltage regulator is in a voltage-mode of operation. In an overload condition, in which the output current is at or above the current-limit threshold, the output current is controlled (i.e., made constant) at the output. In other words, the voltage regulator is in a current-mode of operation.

Figure 2:
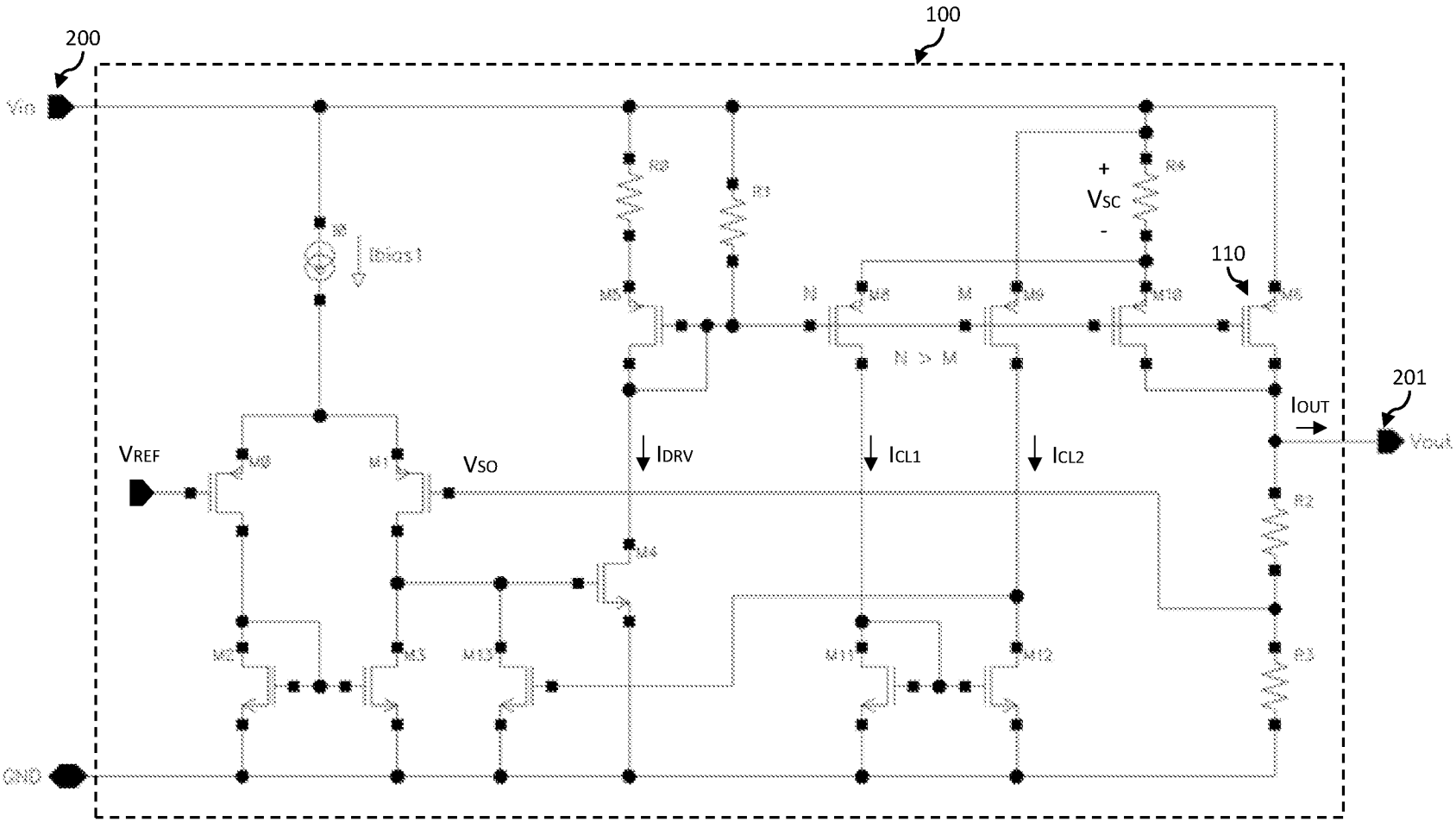
FIG. 2 is a schematic of a linear regulator according to an implementation of the present disclosure.

FIG. 2 is a schematic of a linear regulator according to an implementation of the present disclosure. The linear regulator 100 includes an output transistor (i.e., M6). The output transistor 110 may be controlled according to a voltage-regulation loop (i.e., voltage loop) or a current-limiting loop (i.e., current loop). For example, in a normal-load condition, the voltage loop adjusts the output transistor to make an output voltage ($V_{OUT}$) substantially match (e.g., match) a reference voltage ($V_{REF}$). In an overload condition, the current loop takes over control of the output transistor to prevent an output current ($I_{OUT}$) at the output 201 from exceeding a current limit.

The voltage loop of the linear regulator 100 can include at least three stages. A first stage of the voltage loop includes a differential amplifier (i.e., error amplifier). The differential amplifier can include a pair of matched transistors (M0, M1) that are coupled as a differential pair (e.g., source-coupled PMOS differential pair) and biased by a current source ($I_{BIAS1}$). The differential pair is configured to receive a reference voltage ($V_{REF}$) from a voltage reference (not show) and a sensed-output voltage ($V_{SO}$) corresponding to the output voltage ($V_{OUT}$). The output voltage ($V_{OUT}$) can be sensed by a voltage divider including a plurality of resistors (R2, R3) and the sensed-output voltage ($V_{SO}$) may be a voltage from the voltage divider. The first stage of the voltage loop can also include an input current mirror (M2, M3) to provide a single-ended output of the first stage. The output of the first stage is a voltage-error signal corresponding to a difference between the reference voltage ($V_{REF}$) and the sensed-output voltage ($V_{SO}$), which may be considered as an output-voltage error signal.

A second stage of the voltage loop can include an amplifier. The amplifier may be a transistor (M4) (e.g., NMOS transistor) that is configured to receive the output of the first stage at a controlling (e.g., gate) terminal. In other words, the amplifier of the second stage may be a common-source amplifier with a gain determined (at least partially) by a resistor (R0). The output of the second stage may be a signal (e.g., a driving current, $I_{DR}v$) that is proportional to the output voltage error signal.

A third stage of the voltage loop can include an output current mirror. The output current mirror may include a driving transistor (M5), which functions as an input for the current mirror. The output current mirror also includes the output transistor 110 (M6), which functions as the output of the output current mirror. The output current mirror receives the driving current ($I_{DRV}$) at the input. The driving current creates an output current through the output transistor (M6). The output current ($I_{OUT}$) level may be related to the size of the driving transistor (M5) and the output transistor (M6). For example, the output current can be a multiple of the driving current (i.e., $I_{OUT}=K\cdot I_{DRV}$) multiple. The multiple (i.e., K) corresponds to a size ratio of the input and output transistors (e.g., K=size(M6)/size(M5)). The output current may also depend of the resistor (R0) in series with the input transistor (M5). The driving current ($I_{DRV}$) also creates a voltage drop across the output transistor (M6), which regulates $V_{OUT}$ to $V_{REF}$. The third stage of the voltage loop can also include a load resistor (R1). The load resistor (R1) can function as a load (e.g., a preload) for the amplifier (M4) in a no-load condition, when no load is at the output 201.

The current loop of the voltage regulator includes the current limiter 140 that is configured to affect the voltage loop's control of the output transistor 110 (i.e., M6) so as to limit the current. In some implementations, the current limiter can include three stages. A first stage of the current limiter may include a current-sense transistor (M10) and a current-sense resistor (R4). Terminals (e.g., gain, drain) of the current-sense transistor (M10) and the output transistor (M6) can be directly connected so that the current-sense transistor (M10) conducts a current corresponding to the output current ($I_{OUT}$). The current-sense resistor (R4) can be coupled in series with (e.g., coupled to the source terminal of) the current-sense transistor (M10) so that a sensed-current voltage ($V_{SC}$), which corresponds to the output current ($I_{OUT}$), is generated across the current-sense resistor (R4). In other words, the output current ($I_{OUT}$) may be sensed by the current-sense transistor (M10) and converted to a sensed-current voltage ($V_{SC}$) by the current-sense resistor (R4).

A second stage of the current limiter may include a comparator with an offset voltage (i.e., an offset comparator). The comparator may include a first transistor (M8) (e.g., a first PMOS transistor) and a second transistor (M9) (e.g., a second PMOS transistor) coupled to either side of the current-sense resistor (R4). In this way, the comparator is configured to receive an input voltage difference ($V_{SC}$) across the current-sense resistor (R4) at an input. An offset voltage ($V_{OFF}$) of the comparator is the input voltage difference at which output of the comparator changes. For example, when the input voltage difference ($V_{SC}$) is below the offset voltage, the comparator may output a low signal (i.e., a signal not suitable for driving a subsequent stage), and when the input voltage difference ($V_{SC}$) is above the offset voltage, the comparator may output a high signal (i.e., a signal suitable for driving a subsequent stage).

The offset voltage may be based on (e.g., equal) a threshold-voltage difference ($\Delta V_{TH}$) between the first transistor (M8) and the second transistor (M9). The threshold-voltage difference can correspond to a size difference between the first and second transistors. For example, the first transistor (M8) may have a first size (e.g., N) and the second transistor may have a second (different) size (e.g., M). In some implementations, the first size may be larger than the second size (e.g., N>M).

The comparator is configured to activate (i.e., output a driving signal) when the sensed-current voltage ($V_{SC}$) exceeds the offset voltage ($V_{OFF}$). In other words, the comparator is configured to output a signal suitable for driving a subsequent stage when the output current ($I_{OUT}$) exceeds a current-limit threshold because the output current ($I_{OUT}$) generates a sensed-current voltage ($V_{SC}$) that corresponds to the offset voltage. When activated, the output transistor (M12) of the comparator drives an input for the third stage of the current limiter. Additionally, the driving input for the third stage may increase as the sensed-current voltage ($V_{SC}$) increases above the offset voltage ($V_{OFF}$). In other words, the third stage of the current limiting may be driven at increasing levels corresponding to an increasing output current ($I_{OUT}$) above the current-limit threshold.

The third stage of the current limiter may include a current-limiting transistor (M13) that receives the output of the comparator at a controlling terminal (i.e., a gate terminal). Accordingly, when the comparator is activated the current-limiting transistor (M13) may be driven (i.e., configured) to have an operating voltage (e.g., gate-source voltage) exceeding a transistor-threshold voltage (i.e., an ON voltage of the transistor). In other words, the comparator can drive the current-limiting transistor (M13) to conduct when the output current of the voltage regulator 100 reaches the current-limit threshold. The amount of conduction that the current-limiting transistor (M13) provides can correspond to a difference between the output current ($I_{OUT}$) and the current-limit threshold. For example, the current-limiting transistor (M13) may be configured to conduct more current when the output current is above the current-limit threshold than when the output current is at the current-limit threshold. In other words, a current (e.g., drain current, $I_D$) of the current-limiting transistor (M13) may respond to (i.e., be controlled by) the output current, and in particular, may be related to (e.g., proportional) the output current when the output current is at or above the current-limit threshold.

When activated (e.g., turned ON), the current-limiting transistor (M13) forms a conducting channel between a controlling terminal (e.g., gate) of the amplifier (M4) (i.e., of the voltage loop) and a ground (GND). The current-limiting transistor (M13) can be configured to reduce a driving signal (e.g., gate voltage) of the amplifier (M4) by an amount that corresponds to a current-error signal defined by a difference between the output current ($I_{OUT}$) and the current-limit threshold. The reduction of the driving signal of the amplifier (M4) reduces $I_{DRV}$ and, accordingly, $I_{OUT}$. In other words, for output currents exceeding a current limit threshold, the current-limiting transistor (M13) can be configured to draw current out of the voltage loop to limit the output current of the voltage regulator to the current limit threshold. The current-limit threshold can correspond to the offset voltage of the comparator, which may correspond to a size ratio (e.g., N/M) of the first transistor (M8) and the second transistor (M9) and the current-sense resistor (R4).

At least one advantage of the implementation shown in FIG. 2 is that the current limiter is activated only when the output current ($I_{OUT}$) exceeds the current-limit threshold. In other words, the current limiter is active (i.e., enabled) in a heavy-load condition and inactive (i.e., disabled) in a light-load (e.g., no load) condition. Accordingly, the quiescent current of the current limiter is minimized (e.g., zero) because the current limiter is inactive in a no-load ($I_{OUT}=0$)

condition. As the output current ($I_{OUT}$) is increased, the operating (i.e., bias) current of the current limiter is automatically increased to a value needed for proper operation. Even as the operating current of the limiter is increased, the current consumed by the limiter may remain negligible compared to the output current ($I_{OUT}$). These features are due, at least in part, to the biasing of the comparator.

The comparator is biased with currents based on the output current. A first current ($I_{CL1}$), related to the output current ($I_{OUT}$), biases the first transistor (M8), and a second current ($I_{CL2}$) related to the output current ($I_{OUT}$) biases the second transistor (M9). No fixed current source is necessary to bias (i.e., operate) the first transistor (M8) and/or the second transistor (M9).

The controlling terminals (e.g., gate terminals) of the first transistor (M8) and the second transistor (M9) of the comparator are directly coupled to the controlling terminals (e.g., gate terminals) of the output current mirror (M5, M6) of the voltage loop. Additionally, a terminal (e.g., source terminal) of the second transistor (M9) is coupled directly to a corresponding terminal (e.g., source terminal) of the output transistor (M6). In this configuration, as an operating voltage ($V_{GS}$) of the output transistor (M6) is regulated according to the output current ($I_{OUT}$), the same operating voltage ($V_{GS}$) is applied to the second transistor (M9) so that the bias current ($I_{CL2}$) is proportional to the output current ($I_{OUT}$). Additionally, the first transistor (M8) is coupled via the current-sense resistor (R4) to the corresponding terminal (e.g., source terminal) of the output transistor (M6). In at least this configuration, the operating point of the first transistor (M8) is related to the operating voltage of the output transistor (M6) and the sensed-current voltage ($V_{SC}$) generated across the current sense resistor (R4).

For low output currents, the sensed-current voltage ($V_{SC}$) is negligible and both $I_{CL1}$ and $I_{CL2}$ are proportional to the output current ($I_{OUT}$) but the current ($I_{CL1}$) corresponding to the first transistor (M8) is higher because the first transistor is a larger size (i.e., N/M>1) than the second transistor (M9). When the output current ($I_{OUT}$) reaches a current-limit threshold, the sensed-current voltage ($V_{SC}$) configures operating voltages ($V_{GS}$) of the first transistor (M8) and the second transistor (M9) so that $I_{CL1}$ and $I_{CL2}$ are approximately equal (e.g., are equal). The comparator current mirror (M11, M12) is configured to evaluate this condition.

In some implementations, the current limiter does not consume a fixed current and does not require a fixed source of current (e.g., a bias current source) that is always active (i.e., ON). Instead, the current limiter can consume current derived from the output current, which may vary based on a load at the output 201. In other words, the current limiter is auto-biased based on the output current ($I_{OUT}$) of the voltage regulator 100. In and around a no-load condition ($I_{OUT}$=0), the bias current of the current limiter is approximately zero (e.g., zero). When the bias current is near zero, small variations (noise) may cause unwanted changes (i.e., fluctuations) in states (e.g., active, inactive) of the current limiter. Accordingly, in this condition, the state (ON/OFF) of the current limiter may be defined (i.e., constrained) to a particular state (e.g., OFF) to prevent fluctuations.

Figure 3:
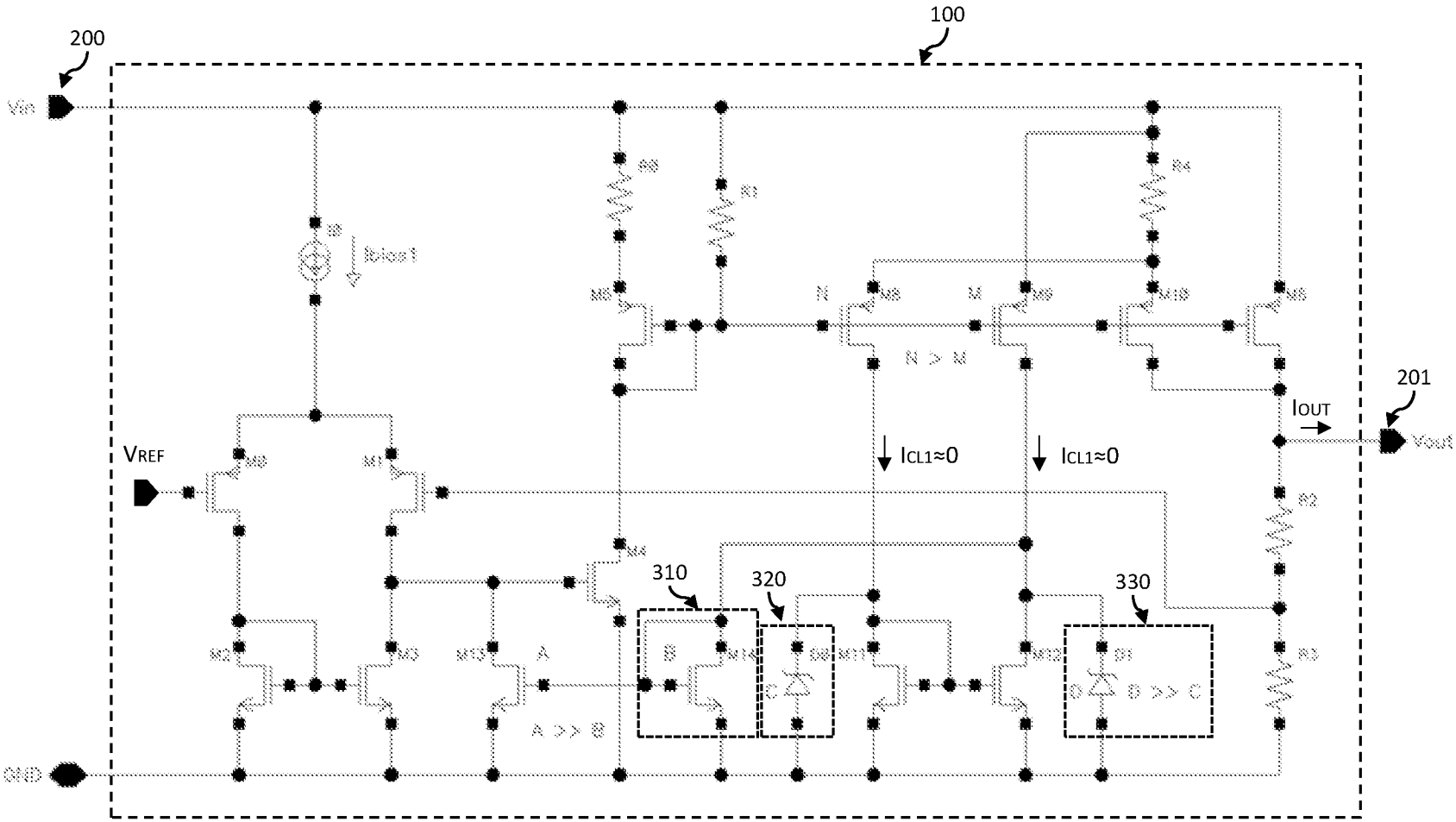
FIG. 3 is a schematic of the linear regulator of FIG. 2 adapted with state-defining components according to a possible implementation of the present disclosure.

FIG. 3 is a schematic of the voltage regulator of FIG. 2 adapted with state-defining components according to a possible implementation of the present disclosure. When no load is coupled to the output 201 of the voltage regulator 100, the operating (i.e., bias) currents ($I_{CL1}$, $I_{CL2}$) of the current limiter are ideally zero because the correct state of the current limiter in this condition is OFF (i.e., inactive). Practically, however, the bias currents in this condition may not be exactly zero due to non-ideal effects, such as current leakage.

The voltage regulator can include a leakage transistor (M14) to prevent a leakage current from affecting the state (i.e., turning ON) the current-limiting transistor (M13). The leakage transistor 310 (M14) can be coupled between the controlling terminal (e.g., gate) of the current-limiting transistor (M13) and ground, configured as a diode-connected transistor, and coupled to the current-limiting transistor in a current mirror configuration with a current ratio related to a size ratio of the transistors (M13, M14). The leakage transistor (M13) may be a size (B) that is much smaller than a size (A) of the current-limiting transistor (M14). In the current mirror configuration, the leakage transistor (M14) is the input transistor of the current mirror and the current-limiting transistor (M13) is the output transistor of the current mirror. The current mirror does not begin to operate until the leakage transistor (M14) reaches a threshold condition (i.e., until the leakage transistor is turned ON). After the leakage transistor (M14) reaches the threshold condition, current is reflected from the input transistor to the output transistor without affecting operation of the current-limiting transistor. Thus, small (e.g., less than 10 milliamps (<10 mA)) output currents are prevented (i.e., shielded) from driving the current-limiting transistor (M13) by the threshold condition of the leakage transistor (M14) in the current mirror configuration. In other words, a size ratio (A/B) of the current mirror can effectively increase (e.g., by 20 or 30 times) the current level necessary to drive the current-liming transistor (M13) (i.e., relative to without the M13, M14 current mirror).

The voltage regulator can also include a first voltage clamp 320 (D0) and a second voltage clamp 330 (D1). The first voltage clamp (D0) can be coupled across (i.e., in parallel with) the input transistor (M11) of the comparator current mirror. The second voltage clamp (D1) can be coupled across (i.e., in parallel with) the output transistor (M12) of the comparator current mirror. The first voltage clamp (D0) and the second voltage clamp (D1) may be implemented as diodes (e.g., Zener diodes) and may function to prevent a relatively high voltage at the input 200 of the voltage regulator from affecting the operation of (e.g., damaging) the low voltage transistors (e.g., M11, M12). The second voltage clamp may be of a size (D) that is much larger than a size (C) of the first voltage clamp. Accordingly, the second voltage clamp (D1) can conduct more current than the first voltage clamp (D0). This asymmetric conduction ensures that a small leakage current does not affect (e.g., turn ON) the current limiter in certain load conditions (e.g., no-load condition).

Figure 4:
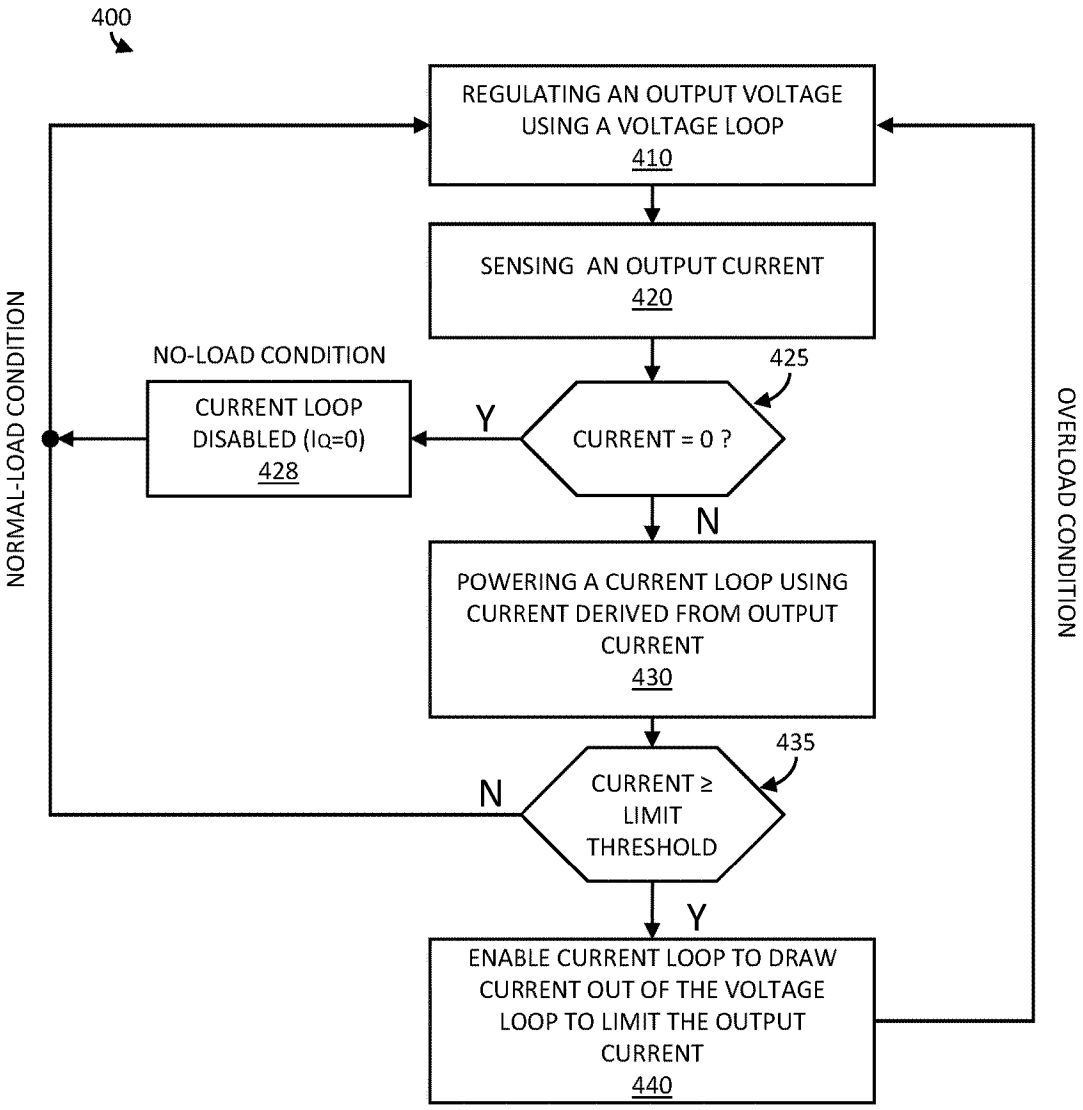
FIG. 4 is a flow chart of a method for voltage regulation with over-current protection according to an implementation of the present disclosure.

FIG. 4 is a flow chart of a method for voltage regulation with over-current protection (i.e., with current limiting). The method 400 includes regulating 410 an output voltage to a fixed level using a voltage loop. As discussed, the voltage loop may include an error amplifier 120 configured to generate a voltage-error signal based on a comparison between the output voltage and a voltage reference 130. The voltage-error signal can then be applied to an output transistor 110 (e.g., power transistor) to adjust the output voltage so as to minimize the voltage-error signal. This process continues while normal-load conditions exists at the output. A normal-load condition occurs for any load that draws a current less than a current-limit threshold.

The method 400 further includes sensing 420 an output current. A non-zero output current (e.g., $I_{OUT}$>0) powers 430 a current loop using a current (i.e., bias current) or currents derived from the output current. When a load is coupled to the output that draws no output current (i.e., $I_{OUT}=0$), a no-load condition can be determined 425. In the no-load condition, the current loop draws no current and is disabled 428 (i.e., $I_Q=0$ for the current limiter).

An overload condition can be determined 435 for a load (e.g., a short) that draws a current at or above a current-limit threshold. In the overload condition, the current loop may be used to limit the output current to a fixed level. In particular, when the output current is greater than (or equal to) a current-limit threshold, the current loop is enabled (i.e. configured, activated) to limit 440 an output current by drawing current out of the voltage loop. For example, when enabled (e.g., by current derived from the output current) components of the current loop are configured to generate a current-error signal based on a comparison between a sensed current to a current reference. The current-error signal is then applied to a current-limiting transistor that is coupled to the voltage loop and that is configured to draw (i.e., short, divert) current out of (i.e., from) the voltage loop.

The disclosed circuits and methods can enable better performance of a voltage regulator by reducing its quiescent current in a no-load condition. For example, a linear dropout regulator (LDO) implemented with the disclosed current limiter may have lower power consumption when placed in a stand-by mode. In another example, LDO implemented with the disclosed current limiter may have more power budget to spend improving other characteristics of the LDO, such as increasing a dynamic range (e.g., of $V_{IN}$) of the LDO or improving a speed (e.g., transient response) of the LDO.

The concepts described herein can be configured to address minimization of the current limit protection quiescent current. In some implementations, quiescent current of modern linear regulators is one of the most closely observed parameters. In some implementations, reaching ultra-low values can be based on special measures to save as much current as possible often compromising other important parameters. In some implementations, current limit protection can be a standard part of linear regulators with its current consumption portion. Some implementations described herein are directed to minimization of (or reduction of) the current limit protection quiescent current thus reaching reduction of the total current consumption.

The concepts described herein can enable enhanced performance of low dropout (i.e., LDO) regulators in terms of either reduction of quiescent current or better dynamic performance for given quiescent current value. The enhanced performance described herein can be advantageous especially in the area of ultra-low and super-low quiescent current LDOs.

An example of an implementation of the concepts described herein is shown in at least FIG. 1, as described above. In some implementations, current limit protection may be needed (e.g., may only be needed) for relatively heavy loads. The current limit protection can be turned off for light loads, which results in a savings of current consumption. In the implementations described herein, a bias-current to supply current limit protection circuitry can be derived from an output current. In some implementations, a correct state is defined when the bias current is near zero (i.e., no load).

The concepts described herein can be contrasted with implementations where current limit protection circuitry is biased with a fixed current (i.e., always on). In such implementations, the voltage can be compared to a defined offset voltage using an offset comparator. The offset comparator takes over control of the regulation loop in case of an overcurrent to limit the output current. Accordingly, the current limit protection consumes a fixed current even in no load conditions.

As described above, FIG. 2 illustrates an example of an implementation where the new current limitation protection described herein is implemented in an error amplifier. The error amplifier can include a voltage regulation loop (main regulation loop). The voltage regulation loop can include: a first stage: differential pair (M0, M1), current mirror (M2, M3); a second stage: amplifier (M4); and output stage: current mirror (M5, output power transistor M6). The error amplifier can include a current limit protection (current loop). The current limit protection can include: a current sense transistor (M10) and resistor (R4); an offset comparator (M8, M9) with current mirror (M11, M12); and an output transistor (M13).

In some implementations, the new current limit protection method of operation can include at least the following concepts. The output current can be sensed by M10 transistor and converted to voltage by R4 resistor. The voltage can be compared with the offset voltage by the offset comparator (M8, M9, M11, M12) based on Vth threshold voltage difference due to different current densities of M8 (N size) and M9 (M size) transistors (N>M). The output transistor (M13) can be configured to connect the current limit protection to the main regulation loop such that in case of overcurrent it takes over control of the regulation and limits the output current. In some implementations, auto-biasing of the offset comparator can be achieved by connecting the M8 and M9 gates to the output current mirror M5 and M6 transistor gates. As M6 transistor Vgs voltage is regulated according to Iout output current demand, virtually the same voltage applies to M8 and M9 transistors. Their operating currents (Icl1, Icl2) can thus be proportional to output current.

In some implementations, as current flowing through M10 transistor and R4 resistor is also proportional to output current, current consumption of the whole current limit protection can be proportional to output current. In cases where there is no load on the output, the current limit protection operating currents and its consumption can be zero (e.g., virtually zero). In such implementations, the protection can be turned off as it is not needed. In some implementations, as output current demand increases the operating currents increase proportionally, and the protection is gradually turned on and can be configured to react in case of overcurrent. In some implementations, the Iq quiescent current of the current limit protection can be virtually zero and can contribute to low quiescent current of the whole LDO regulator. For higher output currents, the operating current of the current limit protection can be automatically set to a value needed for proper operation, which may still be virtually negligible in comparison with output current value.

As described above, FIG. 3 is a diagram that illustrates a schematic of the current limit protection with defined correct state for zero bias current. The circuit can be considered for a no load state. In such implementations, the operating currents are zero. In some implementations, the correct state can be defined in order for the current limit protection to be off. In some implementations, M14 transistor can be included to suppress any impact from potential leakage currents. In some implementations, D0, D1 protective diodes can be used, and D1 can be sized (from a leakage current perspective) to be significantly bigger than D0.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

The invention claimed is:

1. A voltage regulator, comprising:

a voltage loop configured to compare an output voltage to a reference voltage and to adjust the output voltage to match the reference voltage; and a current loop configured to monitor an output current and to draw a current from the voltage loop to limit the output current when the output current is at or above a current limit threshold, the current loop including a current limiter that includes a comparator activated to drive a current-limiting transistor to draw the current from the voltage loop when the output current exceeds the current limit threshold, the current limit threshold corresponding to an offset voltage of the comparator determined by a size difference between a first transistor and a second transistor of the comparator.

2. The voltage regulator according to claim 1, wherein the current limiter is powered by at least one bias current that is proportional to the output current.

3. The voltage regulator according to claim 1, wherein the current limiter is powered by at least one bias current that is not fixed.

4. The voltage regulator according to claim 1, wherein a quiescent current of the current limiter is zero when the output current is zero.

5. The voltage regulator according to claim 1, wherein the voltage loop includes an error amplifier configured to generate a voltage-error signal based on a comparison between the output voltage and the reference voltage.

6. The voltage regulator according to claim 5, wherein the voltage-error signal configures an output transistor to provide a voltage drop between an input and an output of the voltage regulator to adjust the output voltage.

7. The voltage regulator according to claim 1, wherein the voltage loop includes:

a first stage that includes a differential amplifier configured to receive the reference voltage and a sensed-output voltage and to output an output-voltage error signal via an input current mirror;

a second stage that includes an amplifier configured to receive the output-voltage error signal and to output a corresponding driving current; and a third stage that includes an output current mirror having a driving transistor that is configured to receive the driving current and an output transistor that is configured to provide an output current and the output voltage to an output of the voltage regulator.

8. The voltage regulator according to claim 1, wherein current limiter includes:

a first stage that includes a current-sense transistor and a current-sense resistor configured to output a sensed-current voltage that corresponds to the output current of the voltage regulator;

a second stage that includes the comparator; and a third stage that includes the current-limiting transistor that is driven by the comparator to draw the current from the voltage loop when the sensed-current voltage is at or above the offset voltage of the comparator.

9. The voltage regulator according to claim 8, wherein the first transistor and the second transistor of the comparator are a first PMOS transistor and a second PMOS transistor that are sized differently to provide the offset voltage.

10. The voltage regulator according to claim 9, wherein a gate terminal of the first PMOS transistor and a gate terminal of the second PMOS transistor are directly coupled to gate terminals of transistors in an output current mirror of the voltage loop.

11. The voltage regulator according to claim 9, wherein the current-sense resistor is coupled between a source terminal of the first PMOS transistor and a source terminal of the second PMOS transistor.

12. The voltage regulator according to claim 8, wherein the current-limiting transistor is configured in a current mirror with a leakage transistor to prevent a leakage current from causing the current-limiting transistor to draw current from the voltage loop.

13. A linear dropout regulator (LDO) comprising:

an output transistor configured to provide a controllable voltage drop between an input and an output of the LDO; and a current limiter configured to limit an output current of the LDO in an overload condition, the current limiter powered by at least one bias current derived from the output current so that the current limiter is not powered when the output current is below a threshold, the current limiter including:

a first stage that includes a current-sense transistor and a current-sense resistor configured to output a sensed-current voltage that corresponds to the output current;

a second stage that includes a comparator having an offset voltage defined by a first PMOS transistor and a second PMOS transistor that are sized differently, the comparator configured to receive the sensed-current voltage; and a third stage that includes a current-limiting transistor that is driven by the comparator to control the output transistor when the sensed-current voltage is at or above the offset voltage.

14. The linear dropout regulator (LDO) according to claim 13, wherein a gate terminal of the first PMOS transistor and a gate terminal of the second PMOS transistor are directly coupled to gate terminals of transistors in an output current mirror that includes the output transistor.

15. The linear dropout regulator (LDO) according to claim 13, wherein the current-sense resistor is coupled between a source terminal of the first PMOS transistor and a source terminal of the second PMOS transistor.

16. The linear dropout regulator (LDO) according to claim 13, wherein the current limiter draws zero quiescent current in a no-load condition.

17. The linear dropout regulator (LDO) according to claim 13, wherein a quiescent current of the current limiter is zero when the output current is zero.

* * * * *